US009027925B2

(12) United States Patent
Alaas et al.

(10) Patent No.: US 9,027,925 B2
(45) Date of Patent: May 12, 2015

(54) METHODS FOR FEEDING MEDIA SHEETS HAVING INCREASED THROUGHPUT

(71) Applicant: Lexmark International, Inc., Lexington, KY (US)

(72) Inventors: Yusef Hassan Alaas, Austin, TX (US); Kevin Dean Schoedinger, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 74 days.

(21) Appl. No.: 13/873,590

(22) Filed: Apr. 30, 2013

(65) Prior Publication Data

US 2014/0319755 A1 Oct. 30, 2014

(51) Int. Cl.

| | |
|---|---|
| ***B65H 7/02*** | (2006.01) |
| ***B65H 7/12*** | (2006.01) |
| ***B65H 3/06*** | (2006.01) |
| ***B65H 5/06*** | (2006.01) |

(52) U.S. Cl.
CPC ..... *B65H 7/12* (2013.01); *B65H 3/0615* (2013.01); *B65H 5/062* (2013.01)

(58) Field of Classification Search
CPC ..... B65H 7/06; B65H 7/14; B65H 43/02; B65H 7/12; B65H 5/062; B65H 3/0615
USPC ..... 271/10.02, 10.03, 265.01, 265.02, 271/258.01, 259; 399/21
See application file for complete search history.

(56) References Cited

U.S. PATENT DOCUMENTS

| | | | | |
|---|---|---|---|---|
| 7,308,853 | B2 * | 12/2007 | Satoh et al. | 101/118 |
| 8,382,093 | B2 * | 2/2013 | Dan | 271/10.03 |
| 2012/0119436 | A1 * | 5/2012 | Morita et al. | 271/259 |

* cited by examiner

*Primary Examiner* — Jeremy R Severson
(74) *Attorney, Agent, or Firm* — John Victor Pezdek

(57) ABSTRACT

Methods for picking a following sheet of media before the prior sheet of media has been detected exiting a media input tray in an imaging apparatus to increase media throughput. The methods may further include processes for shifting an image area to a shingled sheet of media without having to stop the imaging process.

19 Claims, 7 Drawing Sheets

METHODS FOR FEEDING MEDIA SHEETS HAVING INCREASED THROUGHPUT

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Invention

The present disclosure relates generally to a method and a system for feeding media sheet of media from a stack of media sheets and, more particularly, to a method and system for controlling when a subsequent media sheet is picked after a first media sheet is fed and handling misfed media sheets.

2. Description of the Related Art

A printing device such as an electrophotographic printer or an inkjet printer, for example, typically includes a media sheet feed system having a media picking mechanism for sequentially picking and feeding media sheets from a stack of media sheets.

Manufacturers of printing devices are continually challenged to improve printing device performance. One way in which improvement is sought is to achieve higher throughput rates. To deliver higher throughput, one approach is to keep the interpage gap between fed media sheet as small as possible. However, there has been a long standing need to ensure that a detectable gap exists between each media sheet picked. If the gap is too small or missing, paper jam may occur.

In some designs, sensors are placed in a media tray close to the leading edge of a media sheet to be picked. Typically, the system waits for the sensor to detect the trailing edge of the picked media sheet before committing to the next pick. While this arrangement generally ensures a sufficient gap between sequentially fed media sheets and robustness in a sheet feeding operation, difficulty in designing sensors to be placed very close to the leading edge of the media stack to provide for quick sensing remains a challenge. Oftentimes, the distance from a pick location to the initial media edge sensor defines a gap between fed media sheets that is more than a required interpage gap to achieve desired throughputs and prevent paper jams at the same time. In prior media feeding systems, the minimum interpage gap the systems could deliver was greater than the distance from the pick location to the sensor due to motor constraints during startup and accelerating the media sheet that is being picked up to the desired media process speed. These various factors limit the maximum throughput of the printing device. Accordingly, there is a need to improve throughput.

SUMMARY

In an imaging apparatus having one or more media input trays having a corresponding pick mechanism and a corresponding tray media sensor positioned downstream of a pick point in each of the one or more media input trays, a media path for transporting a media sheet from the one or more media input trays through an image transfer nip to receive a toned image from a print engine to an exit area, and at least one pair of opposed feed rolls and a path media sensor positioned on the media path between the transfer nip and the one or more media input trays, disclosed is a method for feeding a plurality of media sheets to increase media throughput.

In one example embodiment, the method comprises determining for each of the one or more input media trays corresponding lengths of sheets of media contained therein, for a print job having a plurality of sheets, each of a length L; picking a media sheet N from a selected one of the one or more media input trays having a plurality of sheets of media of the length L and feeding the media sheet N into the media path; using the length L and a predetermined throughput rate calculating a pick delay time period to pick a media sheet N+1 setting an interpage gap between the media sheet N and the media sheet N+1 and allowing a trailing edge of the media sheet N to clear a pick point in the selected one of the one or more media input trays and remain upstream of the corresponding tray media sensor; picking the media sheet N+1 from the selected one of the one or media input trays after expiration of the pick delay time period allowing for increased media throughput.

Thereafter, the example method determines whether or not a trailing edge of the media sheet N is detected at the tray media sensor of the selected one of the one or more media input trays, and, when it is determined that the trailing edge of the media sheet N is detected at the tray media sensor of the selected one of the one or more media input trays, continuing the feeding of the media sheet N toward the transfer nip using the one or more opposed pairs of feed rolls and continuing the picking of the media sheet N+1. When it is determined that the trailing edge of the media sheet N is not detected at the tray media sensor of the selected one of the one or more media input trays, then, a determination is made whether or not the trailing edge of the media sheet N is detected within a predetermined transit time period plus and minus a tolerance time at a first path media sensor downstream of the tray media sensor of the selected one of the one or more media input trays.

When it is determined that the trailing edge of the media sheet N is detected within the predetermined travel time period plus and minus a tolerance time at the first path media sensor, the feeding of the media sheet N toward the transfer nip using the one or more opposed pairs of feed rolls continues along with the picking of the media sheet N+1. When it is determined that the trailing edge of the media sheet N is not detected within the predetermined travel time period plus and minus a tolerance time at the first path media sensor, then, a determination is made whether or not the trailing edge of the media sheet N is detected at the first path media sensor downstream of the tray media sensor of the selected one of the one or more media input trays after the predetermined transit time period plus the tolerance time has elapsed. When it is determined that the trailing edge of the media sheet N has been detected at the first path media sensor after the predetermined transit time period plus the tolerance time has elapsed, the picking of media sheet N+1 is momentarily stopped. When it is determined that the trailing edge of the media sheet N has not been detected at the first path media sensor after the predetermined transit time period plus the tolerance time has elapsed, an unexpected sheet has been fed and the picking of the media sheet N+1 is stopped.

When the unexpected sheet has been fed, the example method further calculates an amount of shingle intrusion between the media sheet N and the unexpected sheet and determines based on the calculated amount of shingle intrusion, whether or not an image area can be printed on the media sheet N, and, if not, then if the image area can be printed on the unexpected sheet. If printing of the image area on either media sheet N or the unexpected sheet can occur, then both sheets are fed to the transfer nip for printing on the appropriate sheet. If printing is not possible on either media sheet N or the unexpected sheet, then a misfeed is declared.

BRIEF DESCRIPTION OF THE DRAWINGS

The above-mentioned and other features and advantages of the various embodiments, and the manner of attaining them, will become more apparent and will be better understood by reference to the accompanying drawings.

DETAILED DESCRIPTION

Figure 1:
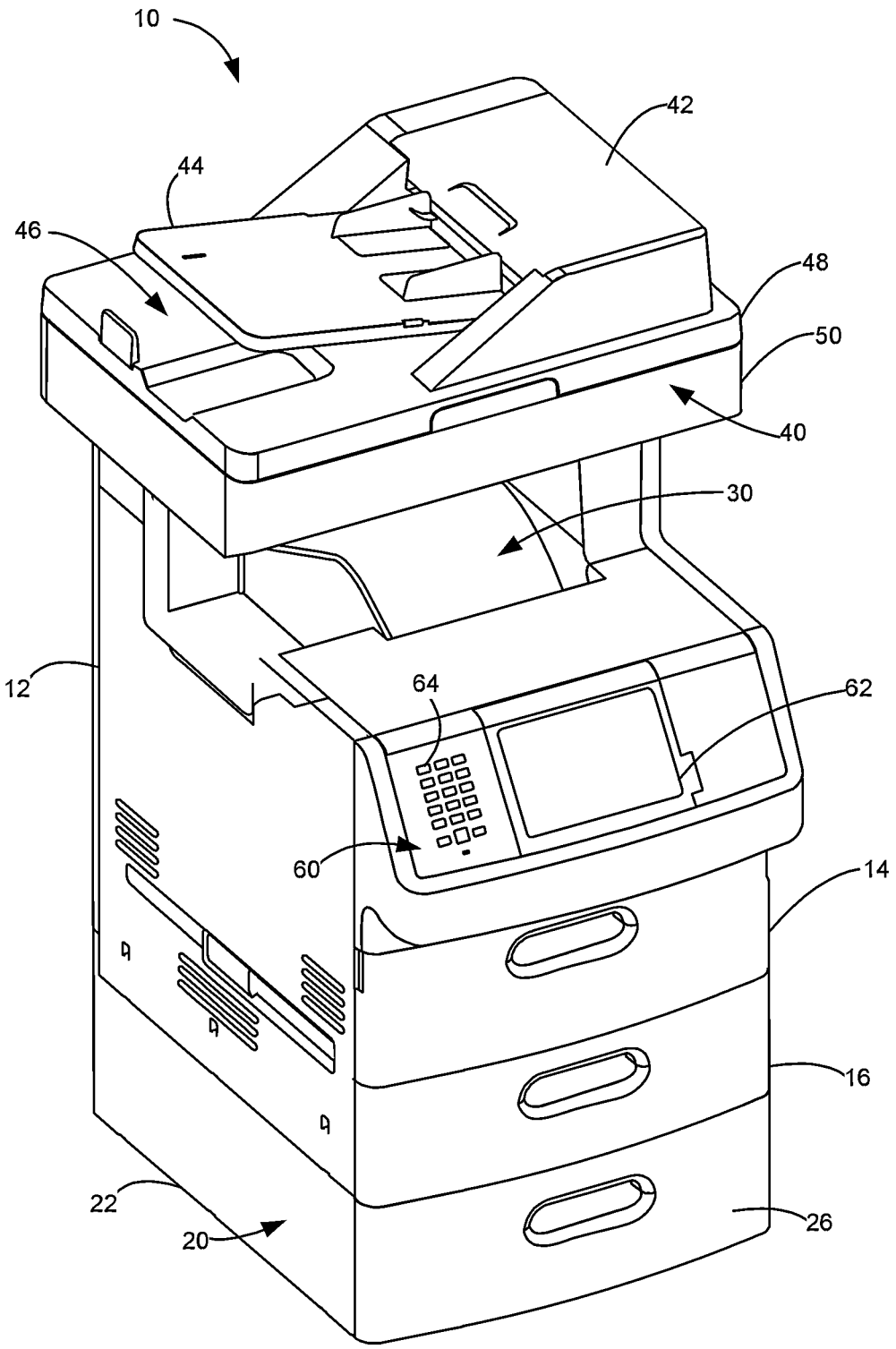
FIG. 1 is a perspective view of one example embodiment of an imaging apparatus.

The following description and drawings illustrate embodiments sufficiently to enable those skilled in the art to practice the present disclosure. It is to be understood that the disclosure is not limited to the details of construction and the arrangement of components set forth in the following description or illustrated in the drawings. The invention is capable of other embodiments and of being practiced or carried out in various ways. For example, other embodiments may incorporate structural, chronological, electrical, process, and other changes. Examples merely typify possible variations. Individual components and functions are optional unless explicitly required, and the sequence of operations may vary. Portions and features of some embodiments may be included in or substituted for those of others. The scope of the application encompasses the appended claims and all available equivalents. The following description is, therefore, not to be taken in a limiting sense and the scope of the present invention is defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Spatially relative terms such as "top", "bottom", "front", "back", "rear" and "side", "above", "under", "below", "lower", "over", "upper", and the like, are used for ease of description to explain the positioning of one element relative to a second element. These terms are generally used in reference to the position of an element in its intended working position within an image forming device. Further, terms such as "first", "second", and the like, are used to describe various elements, regions, sections, etc. and are not intended to be limiting. The term "image" as used herein encompasses any printed or digital form of text, graphic, or combination thereof. Like terms refer to like elements throughout the description.

Figure 2:
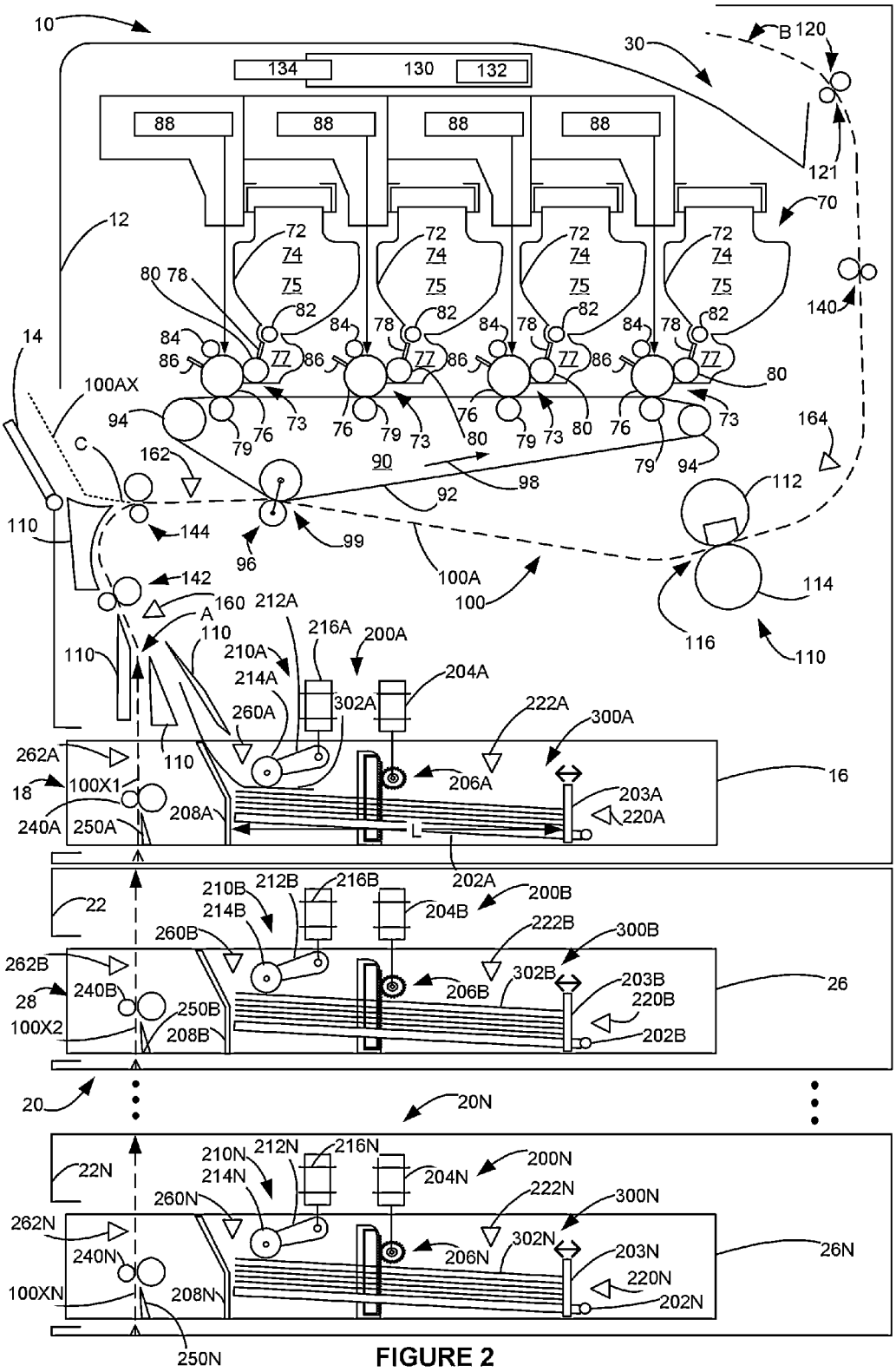
FIG. 2 is a schematic diagram of the imaging apparatus in FIG. 1 illustrating the media feed path from the media input trays to the exit area.

Referring now to the drawings and particularly to FIGS. 1-2, there is shown an imaging apparatus 10. Imaging apparatus 10, which may be a standalone imaging device, includes a housing 12 having a foldout multipurpose media feed tray 14, a moveable media support such as for example removable input media tray 16 for supporting sheets of media, such as, but not limited to, paper, card stock film, such as transparencies, or printer labels. Multipurpose media feed tray 14 is used to feed a single media sheet or a limited number of media sheets into imaging apparatus 10, such as for example envelopes or letterhead. Multipurpose media feed tray 14 may also be used to feed thicker media that may not be able to accommodate the bends found in the portion of media path leading from media tray 16. Input media tray 16 may be inserted into or removed from the housing 12 through an opening 18.

One or more option assemblies 20 may be attached to imaging apparatus 10 to provide additional input media sources. As illustrated one option assembly 20 is shown positioned beneath imaging apparatus 10. Additional option assemblies 20 would be positioned similarly beneath one another. Each option assembly 20 includes a housing 22 and a moveable media support such as removable media input tray 26 that is slidably received into the option housing 22 via an opening 28. Media tray 26 may be sized to hold the same number of media sheets as integrated media tray 16 of imaging apparatus 10 or may be sized to hold different quantities and different sizes of media sheets. A media output area 30 may be disposed in the imaging apparatus 10 in which printed media sheets are placed.

Imaging apparatus 10 may also include a scanner 40 including an auto-document feeder (ADF) 42 having a media input tray 44 and a media output area 46 provided on a lid 48 mounted on base 50. Scanner 40 may include scan bars in both ADF 42 and base 50 to provide for single and duplex scanning of images. In one form, media input trays 16, 26 may hold printed documents to be scanned or such documents may be fed through multipurpose media tray 14. The aspects of methods disclosed herein relating to increasing sheet throughput may also be applied to sheets of media being fed from media input tray 44.

A user interface 60, such as a graphical user interface, is provided on imaging apparatus 10 for receiving user input concerning operations performed or to be performed by imaging apparatus 10, and for providing to the user information concerning the same. User interface 60 may include a display panel 62, which may be a touch screen display in which user input may be provided by the user touching or otherwise making contact with graphic user icons in the display panel 62. Display panel 62 may be sized for providing graphic images that allow for convenient communication of information between imaging apparatus 10 and the user. In addition or in the alternative, a plurality of input keys 64 may be provided to receive user input.

FIG. 2 is a partial schematic of imaging apparatus 10 illustration of a media feed path from the media multipurpose tray 14 and input trays 16, 26. Imaging apparatus 10 includes one or more imaging stations 70. Each imaging station 70 includes a toner cartridge 72 and an imaging unit 73. In some embodiments, toner cartridge 72 and imaging unit 73 comprise a single unit. Each of the imaging stations 70 is mounted such that photoconductor (PC) drums 76 of imaging stations 70 are substantially parallel. In one embodiment, each of imaging stations 70 is substantially the same except for the color of toner stored and transferred.

Each cartridge 72 includes a toner reservoir 74 to contain toner, a doctor blade 78 and a developer roll 80. The toner reservoir 74 may be divided into an upper sump area 75 and a lower sump area 77. An agitating toner paddle may be positioned within upper sump area 75 to move the toner within the reservoir 74. A toner metering bar 82 is configured to transfer a predetermined amount of toner per rotation from upper sump area 75 to lower sump area 77. As the toner is placed on the developer roll 80, doctor blade 78 evens the toner to a predetermined thickness. In one embodiment, toner reservoirs 74 each contain one of black, magenta, cyan, or yellow toner. In one embodiment, each of the toner reservoirs 74 is substantially the same. In another embodiment, the toner reservoirs 74 include different capacities.

Each imaging unit 73 includes a charging roll 84, a PC drum 76 and a cleaning blade 86. Charging roll 84 forms a nip with PC drum 76 and charges the surface of PC drum 76 to a specified voltage. A laser beam from a printhead 88 is directed to the surface of PC drum 76 and discharges those areas it contacts to form a latent image. Developer roll 80, which also forms a nip with PC drum 76, then transfers toner to PC drum 76 to form a toner image. The toner is attracted to the areas of the PC drum 76 surface discharged by the laser beam. The cleaning blade 86 then removes any remaining particles of toner from the PC drum 76 after the toner image is transferred to either the media or an intermediate transfer mechanism.

While an electrophotographic printing apparatus is illustrated in imaging apparatus 10 any of a variety of different types of printing mechanisms including dye-sublimation, dot-matrix, or ink-jet printing apparatuses may be used.

In the embodiment shown, an intermediate transfer mechanism (ITM) 90 is disposed adjacent to each of the imaging stations 70. In this embodiment, ITM 90 is formed as an endless belt 92 trained about a series of rollers 94 and through opposed rollers 96. During image forming operations, belt 92 moves past each of imaging stations 70 (in a counter-clockwise direction 98 as viewed in FIG. 2. One or more of PC drums 76 apply toner images in their respective colors to belt 92. In one embodiment, toner transfer rollers 79 positioned beneath transfer belt 92 adjacent each PC drum 76 provide a positive voltage field the attracts the toner image from PC drums 76 to the surface of moving transfer belt 92. As ITM 90 revolves, transfer belt 92 collects the one or more toner images from imaging stations 70 at a first transfer area beneath each of imaging stations 70 and then conveys the toner images to a media sheet at a second transfer area. The second transfer area includes a transfer nip 99 formed between a pair of opposed rollers 96. Alternative embodiments include those wherein the toner images are applied directly to the media sheet by PC drum(s) 76.

After receiving the toner images, the media sheets are moved further along the media path 100, indicated by the dashed line, and into a fuser 110. Fuser 110 includes a fusing roll 112, or belt, and a backup roll 114 that form a fuser nip 116 to apply pressure and or heat to the toner image on the media sheet as it passes through fuser nip 116. The combination of heat and pressure fuses or adheres the toner image to the media sheet. The fused media sheets then pass through exit nip 121 of opposed exit rolls 120 via one or more pairs of opposed feed rolls 140 that are located downstream from fuser 110 and into an output area 30 or, as known in the art, through a duplex path (not shown) beginning adjacent exit rolls 120 and looping back to the second transfer area and transfer nip 99 for duplex printing.

In the embodiment illustrated, imaging apparatus 10 is a color laser printer. In another embodiment, imaging apparatus 10 is a mono printer comprising a single toner cartridge 72 and a single imaging unit 70 for forming toner images in a single color. In another embodiment, imaging apparatus 10 is a direct transfer device that transfers the toner images from the one or more PC drums 76 directly to the media sheet. As used herein, the term media sheet is meant to encompass not only paper but also labels, envelopes, fabrics, photographic paper or any other desired substrate that can receive a toner image.

Imaging apparatus 10 further includes a controller 130 that controls the functioning of imaging apparatus 10 and the various components therein such as media feed motors, media sensors, media edge detectors, position detectors, print engines, fusers, etc. Controller 130 oversees the functioning of imaging apparatus 10 including movement of the media along media path 100 via opposed feed and exit rolls, imaging station(s) 70, ITM 90, printheads 88, and user interface 60. Each toner cartridge 72, toner reservoir 74, imaging unit 73 and/or fuser 110 may also contain its own associated memory. For clarity in FIG. 2, the communication links between controller 130 and the various components which are controlled is not shown as how this is accomplished is well understood by those of ordinary skill in the art. As used herein, the term "communication link" generally refers to a structure that facilitates electronic communication between two components, and may operate using wired or wireless technology. Accordingly, a communication link may be a direct electrical wired connection, a direct wireless connection (e.g., infrared or r.f.), or a network connection (wired or wireless), such as for example, an Ethernet local area network (LAN) or a wireless networking standard, such as IEEE 802.11.

It should be realized that for the various opposed rolls, such as exit rolls 120, feed rolls 140, transfer rolls 96, etc one roll is a driven roll and the other is an idler roll. The driven roll is in operable communication with controller 130 and is indicated in the Figures by the larger roll in the pair of opposed rolls. Unless otherwise stated, references to these opposed rolls include both the driven roll and idler roll.

Controller 130 may include a processor unit 132 and an associated memory 134, and may be formed as one or more Application Specific Integrated Circuits (ASICs). Memory 134 may be any volatile or non-volatile memory of combination thereof such as, for example, random access memory (RAM), read only memory (ROM), flash memory and/or non-volatile RAM (NVRAM). Alternatively, memory 134 may be in the form of a separate electronic memory (e.g., RAM, ROM, and/or NVRAM), a hard drive, a CD or DVD drive, or any memory device convenient for use with controller 130. The user interface 60 may include firmware maintained in memory 134 within housing 12 which may be performed by processor 132 of controller 130 or another processing element.

Two sheet feed systems 200A, 200B are illustrated, one in input media tray 16 of imaging apparatus 10 and the other in input media tray 26 of option assembly 20, respectively. As illustrated, each sheet feed system may include a lift plate, lift plate motor, media stack height sensors, and a pick mechanism. Lift plates 202A, 202B are pivotally mounted in input media trays 16, 26 and are elevated by motors 204A, 204B via illustrated rack and pinion assemblies 206A, 206B. This raises stored media stacks 300A, 300B to pick mechanisms 210A, 210B, respectively. Alternatively, no lift plates and lift motors may be used and pick mechanisms 210A, 210B may be rotated down into media input trays 16, 26 to pick a top most media sheet from the stack of media sheets 300A, 300B, respectively.

Adjustable media supports 203A, 203B slidably engage with the bottom of media trays 16, 26, as indicated by the doubled-headed arrows, and are set by a user to a length L with respect to media dams 208A, 208B which will accommodate a given media size, for example, letter, legal, ledger, A4, A5, etc. Corresponding lengths L for the example media sizes at which media supports 203A, 203B may be set would be about 279 mm, 356 mm, 432 mm, 297 mm, and 210 mm, respectively. Media length sensors 220A, 220B may be provided to supply the position of media supports 203A, 203B to controller 130 which uses this information to determine the magnitude of length L. A user may also provide this length information to controller 130 via user interface 60. Adjustable media side edge guides (not shown) may also be provided to position media stacks 300A, 300B on lift plates 202A, 202B between the sides of media trays 16, 26. For a center-fed media feed system two opposed edges guides are provided and move the media to a center position in the media tray. For a reference edge feed system where one side of the media tray is used as a reference surface, a single media edge guide is used to bias the media against the reference surface. Either type of media feed system may be used with the present invention.

Stack height sensor 222A, 222B may be disposed within each of media trays 16, 26 for sensing the height of media stacks 300A, 300B disposed in their respective media storage locations therein. For example, media stacks 300A, 300B may be raised by motors 204A, 204B in indexed moves via lift plates 202A, 202B based on outputs from the stack height sensors 222A, 222B in order to ensure that the top most sheet of the stack of media sheets is within a desired pick height range about the location of the bottom of a pick roll 214A, 214B. Stack height sensors 222A, 222B may be a flag-photointerrupter type sensor or a light and photoreceptor type sensor.

Illustrated pick mechanisms 210A, 210B include pick arms 212A, 212B mounting one or more pick rolls or pick tires 214A, 214B which may rest on a topmost media sheet 302A, 302B of stack of media sheets 300A, 300B in input media trays 16, 26. Under the direction of controller 130, drive motors 216A, 216B rotate pick rolls 214A, 214B to drive media sheet 302A, 302B into the angled portion of media dams 208A, 208B, and ultimately into media path 100. Sheet 302A is depicted as being picked by pick mechanism 210A and its leading edge having already traveled past media dam 208A and about to enter the media path 100 at point A.

In an example embodiment, pick mechanisms 210A, 210B may be auto compensating pick modules (ACM) having a drive train encased within pick arms 212A, 212B therein for transmitting a rotational force and downward force from drive motors 216A, 216B to pick rollers 214A, 214B. The drive train may include a plurality of gears, pulleys, belts or the like for transferring rotational power from the drive motor to the pick roller. Drive motors 216A, 216B may be D.C. motors and are communicatively coupled to controller 130 and are operably coupled to pick mechanisms 210A, 210B using transmissions and clutches or the like as is known in the art.

Additional option assemblies may be added below option assembly 20. These additional option assemblies, as designated by the ellipses and the final option in the stack, option assembly 20N, would be configured similarly to option assembly 20 and may hold a different type or size of media sheet or just provide an additional supply of a media found in another option assembly. Because option assembly 20N is also communicatively coupled to controller 130 and functions substantially the same as option assembly 20, option assembly 20N and its features carry similar reference numerals to those in option assembly 20 and will not be further described.

With reference to FIG. 2, media path 100 extends through imaging apparatus 10 from the output of media tray 16 to exit area 30 and is the path along which media sheets travel through the imaging apparatus 10. Media path 100, as illustrated, is a serpentine path, a C-path or S-path, comprised of several portions—a main portion 100A, an auxiliary path 100AX, and one or more path extensions 100X. The serpentine shape means that the bottom surface of each media sheet that is feed from media tray 16, 26 will receive the toned image at transfer nip 99.

Main portion 100A extends from a point adjacent to where a media sheet exits media tray 16, such as point A, and ends at a point adjacent to exit area 30 downstream of exit rollers 120 such as point B.

Auxiliary path 100AX, indicated by a dotted line, extends from multipurpose feed tray 14 and merges into main portion 100A of media path 100 upstream of at least one pair of feed rollers, such as at point C, that in turn are upstream of transfer nip 99 and at least one media edge sensor, such as media sensor 162.

Path extension 100X1 is illustrated as extending through a front path of media tray 14. The downstream end of path extension 100X1 is illustrated as merging with main portion 100A at point A while the upstream end thereof extends through the bottom of tray 16 and housing 12. Path extension 100X2 extends through option assembly 20 and media tray 26 therein with the downstream end thereof being adjacent to the upstream end of path extension 100X1 and the upstream end thereof extending through the bottom of media tray 26 with the bottom of housing 22 of optional assembly 20. Each additional option assembly N that is added would have a path extension 100XN substantially the same as path extension 100X2. Path extensions 100X1-100XN are aligned so that media being transported along them will move in an unobstructed manner into main portion 100A of media path 100. The media path 100 including auxiliary media path 100AX or media path extensions 100X1-100XN may be configured as an L-shaped media path, a C-shaped media feed path, a S-shaped media feed path, a straight-through feed path or other media feed path configuration known in the art.

Misalignment of path extensions 100X1-100XN may be a cause of media misfeeds, media damage, and media jams. Guides 110 of various shapes and having various curvilinear surfaces may be provided in imaging apparatus 10 to help direct and align the transported media sheets along media path 100. Similar guides, such as guide 250A-250N may also be provided in media trays 16-26N.

Main portion 100A of media path 100 passes through one of more sets of opposed feed roll pairs 142, 144 and, going in a downstream direction, through second transfer area at transfer nip 99, fuser nip 116 and exit nip 121. The number and placement of opposed feed roll pairs is a matter of design choice. In each of media trays 16-26N, feed rolls 240A-240N are positioned adjacent media path extensions 100X1-100XN.

Mounted adjacent to media path 100 are a plurality of media sensors that are used to detect the leading and trailing edges of a media sheet as it is being transported along media path 100. Media sensor 160 is shown positioned upstream of feed rolls 142. Media sensor 162 is shown positioned downstream of feed rolls 144 and upstream of transfer rolls 96. Media sensor 164 is shown placed downstream of fuser assembly 110. Provided adjacent media path extensions 100X1-100XN are media sensors 262A-262N. As shown sensors 262A-262N are placed within a front portion of media trays 16, 26. These sensors along media path 100 may also be referred to as path media sensors 160, 162, 164, 262A-262N. In addition, media sensors 260A-260N may also be referred to as tray media sensors 260A-260N, are placed in media trays 16, 26-26N downstream of pick rolls 214A-214N, and, as illustrated, are adjacent media dams 208A-208N. Tray media sensors 260A-260N are positioned as close as practicable to the leading edge of the media stacks 300A-300N.

Both path media sensors 160, 162, 164, 262A-262N and tray media sensors 260A-260N may be, for example, a flag and photointerrupter type of sensor. When the leading edge of the media sheet strikes the flag, the flag blocks or unblocks the photointerrupter and the output signal changes from a first state to a second state and when the trailing edge of the media sheet passes the flag, the flag unblocks or blocks the photointerrupter and the output signal changes from a second state to a first state. Other designs for the path and tray media sensors providing a similar alternating state change in an output signal may be used.

The number and placement of media sensors is a matter of design choice. However, there must be a least one path media sensor downstream of each tray media sensor. Either or both of path media sensors 160, 162 may be used as a downstream path media sensor to tray media sensor 260A. Any or all of path media sensors 262A, 160, and 162 may be used the downstream path media sensor to tray media sensor 260B. Any or all of path media sensors 262B, 262A, 160 and 162 may be used as a downstream path media sensor to a tray media sensor found in a third option assembly, if one was present, and so on, as additional option assemblies are added to imaging apparatus 10. In other words, as more option assemblies are added, more path media sensors become available to serve as a downstream path media sensor to each newly added tray media sensor.

Figure 3:
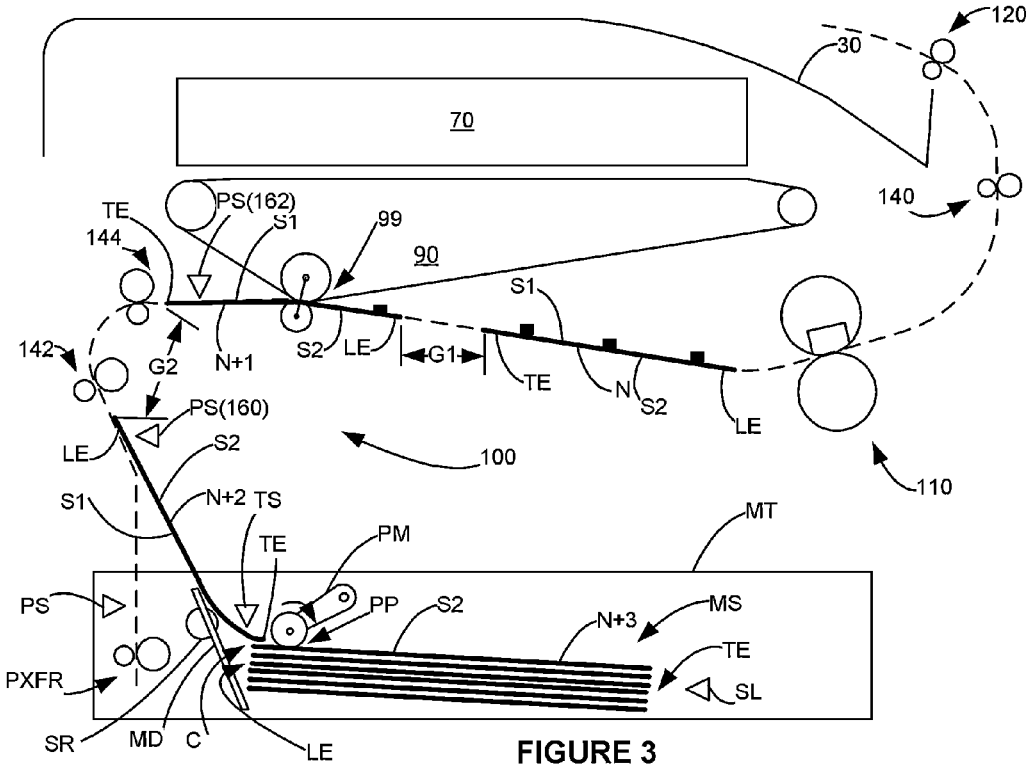
FIG. 3 is a schematic representation of normal media sheet feeding along the media path of the imaging apparatus of FIG. 2.

Referring to FIG. 3, a four page simplex print job is shown progressing along media path 100. Each media sheet has surfaces S1 and S2 as indicated. Because of the C-shape or S-shape of media path 100, a toned image will be received on surface S1 which is the bottom surface of the media sheet when present in the media stack MS. Media sheets N–N+3 are fed from a media stack MS in media tray MT. Media stack MS may represent media stack 300A-300N and media tray MT may represent media tray 16-26N.

Media tray MT contains a pick mechanism PM having a pick point PP adjacent to but upstream of the leading edge LE of media stack MS. Pick mechanism PM may represent pick mechanism 200A-200N. Media tray MT contains a media dam MD. Media dam MD may represent media dam 208A-208N. Also shown is tray media sensor TS that may represent tray media sensors 260A-260N. A sheet length sensor SL is provided that may represent media length sensors 220A-220N. In addition, path media sensor PS and path extension feed rolls PXFR are also shown in media tray MT. Path media sensor PS represents any path media sensor located downstream of the tray media sensor TS in media tray MT and upstream of transfer nip 99. Path media sensor PS may designate path media sensors 160, 162, 262A-262N. Path extension feed rolls PXFR may designate feed rolls 240A-240N.

As can be seen feeding of media sheets N through N+2 has occurred normally without the presence of an unexpected sheet on media path 100. Media sheet N is shown having passed through transfer nip 99 and on surface S1 has received a toner image represented by small black rectangles and is approaching fuser assembly 110. Media sheet N+1 is shown passing through transfer nip 99 having on its surface S1 a toned image adjacent its leading edge LE and having a portion yet to receive a toned image. The trailing edge TE of media sheet N+1 is shown approaching path media sensor PS (162) that is shown immediately upstream of transfer nip 99. Between media sheets N and N+1 there exists an interpage gap G1 and between media sheets N+1 and N+2 there is interpage gap G2. Interpage gaps G1 and G2 are controlled by controller 130 initially during picking of each media sheet from media tray MT using pick mechanism PM, and, then, if needed, by adjusting the rotational speed of the feed rolls 142, 144, transfer rolls 96, and fuser assembly 110 along media path 100.

The leading edge LE of media sheet N+2 is shown having passed path media sensor PS (160) immediately downstream from media tray MT while its trailing edge TE has not yet cleared tray media sensor TS but has cleared the pick point PP. Because controller 130 knows the length of the media sheet and the location of the pick point PP, controller 130 can determine the time when the trailing edge TE of each sheet being fed will clear pick point PP. In accordance with the present invention, when the predetermined time at which trailing edge TE of media sheet N+2 being picked should clear pick point PP has passed, pick mechanism PM is actuated by controller 130, as indicated by the curved arrow, to begin picking media sheet N+3. As indicated at point C, when this is occurring, there may be a small overlap or little or no interpage gap between trailing edge TE of media sheet N+2 and the leading edge LE of media sheet N+3. By the time that media sheet N+3 has been accelerated by pick mechanism PM to the needed process speed, media sheet N+2 will have moved downstream into the next set of downstream feed rolls, such as feed rolls 142, and an interpage gap will open up between media sheets N+2 and N+3 and for subsequently picked media sheets.

Figure 4:
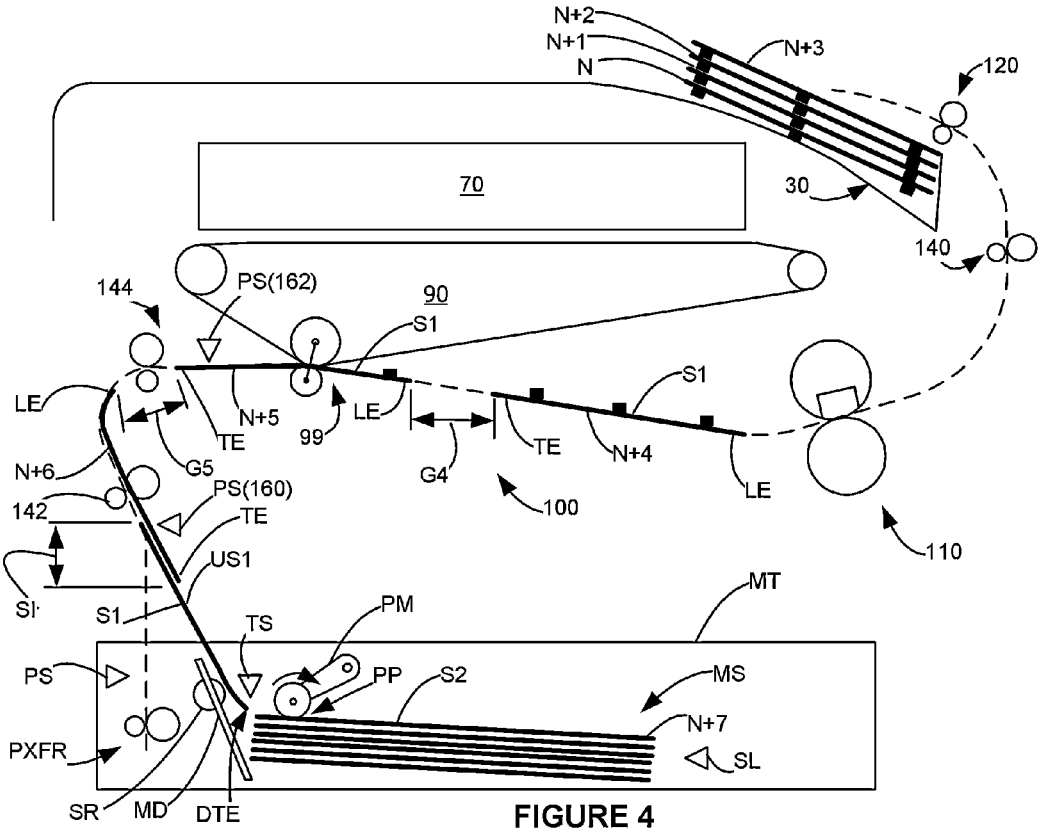
FIG. 4 is a schematic representation of media sheet feeding illustrating an unexpected sheet being fed along the media path of the image apparatus of FIG. 2.

Referring to FIG. 4, a second four page simplex print job is shown progressing along media path 100 indicted by the dashed line. The first print job of media sheets N–N+3 is shown as output media stack OMS in output area 30. Media sheets N+4 and N+5 have been successfully picked from media tray MT and are proceeding as expected along media path 100 having interpage gap G4 therebetween. Media sheet N+4 has passed through transfer nip 99 and is approaching fuser assembly 110. Media sheet N+4 now carries a toned image on its surface S1. The leading edge LE and a forward portion of media sheet N+5 has passed through transfer nip 99 and now carries a toned image on its surface S1. The trailing edge TE of media sheet N+5 is shown approaching downstream path media sensor PS(162). Leading edge LE of media sheet N+6 is approaching feed rolls 144. An expected interpage gap G5 is present between media sheets N+5 and N+6. At this point the second print job is proceeding as expected.

A problem however has occurred with media sheet N+6. An unexpected sheet US1 has shingled onto to surface S1 of sheet N+6. The shingle intrusion or overlapped portion of unexpected sheet US1 is designated SI in FIG. 4. Shingling occurs when the picked media sheet and a media sheet immediately below fail to separate due to inter-sheet frictional forces and are fed together. As is known in the art, one or more separator rolls SR, rotating counter to the media sheet feed direction, may be provided in media dam MD to help prevent shingling. However, shingling may still occur. As will be appreciated when shingle intrusion SI reaches transfer nip 99 a portion of the image area intended to be transferred onto surface S1 of media sheet N+6 may actually be transferred onto the surface S1 of unexpected sheet US1.

The actual trailing edge TE of media sheet N+6 is upstream of path media sensor PS(160). But due to shingling, the actual trailing edge TE of media sheet N+6 has not been detected by tray media sensor TS. Instead, the detected trailing edge DTE is actually the trailing edge of the unexpected sheet US1. Because the combined length of media sheet N+6 and unexpected sheet US1 is longer than that of media sheet N+6 alone, the time between when the leading edge of sheet N+6 is detected by tray media sensor TS and the detected trailing edge DTE of unexpected sheet US1 is detected will be longer than the expected time for detecting the leading edge LE and actual trailing edge TE of media sheet N+6 alone. Because the speed of the media sheets N+1 and US1 are known, the amount of shingle intrusion SI that occurs can be calculated by controller 130. This information may be used to further process these two media sheets N+6 and US1. Had no shingling occurred between media sheet N+6 and unexpected sheet US1, unexpected sheet US1 would have been the next sheet to have been picked, namely, media sheet N+7.

Figure 5A:
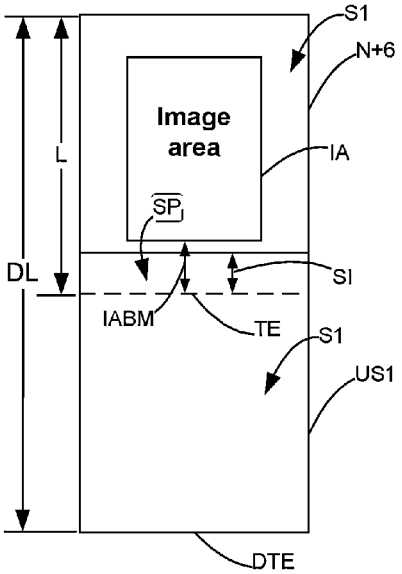
FIG. 5A illustrates shingle intrusion of an unexpected sheet occurring in a non-image area of a fed media sheet and FIG. 5B illustrates the image being printed on the fed media sheet.

Shown in FIGS. 5A-6B are two possible shingling scenarios and printing outcomes. Shown on media sheet N+6 in both FIGS. 5A and 6A is an image area IA which is the area on surface S1 of media sheet N+6 that will contain a toned image. The image area IA is the area on the surface of the media sheet to which toner may be transferred. For example, if the toned image was lines of text, the image area IA would be the margins between which text would be printed. If the toned image to be placed on the media sheet was simply a picture of a dog, the image area would be the outline of the dog. Image area IA may contain both text and images. In general, the image area bottom margin IABM is the space between the bottom of the image area IA and the trailing edge TE of the media sheet intended to be fed along the media path 100. The value of IABM for a given media sheet is known by controller 130. As shown, the image area bottom margin IABM is the space between the bottom of the IA and the trailing edge TE of media sheet N+6.

Figure 5B:
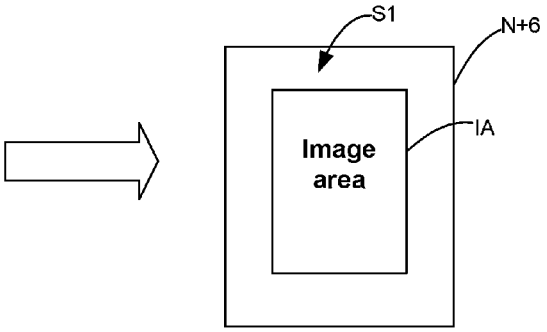

In FIG. 5A, unexpected sheet US1 has created a shingle intrusion SI occurring below image area IA that does not intrude upon the image area IA of media sheet N+6. Controller 130 in one form may calculate the value of shingle intrusion SI by using the following: SI=2L−DL where L is the length of the sheet intended to be fed and DL is the detected length. When the SI value is less than or equal to the IABM value, the shingle intrusion SI does not interfere with the printing of the image area IA onto the media sheet intended to be fed, e.g. sheet N+6. Because controller 130 knows where on media sheet N+6 toner will be transferred, with this degree of shingle intrusion, controller 130 would recognize that media sheet N+6 can still be successfully printed. Accordingly both media sheet N+6 and unexpected sheet US1 are fed through the transfer nip 99 and as shown in FIG. 5B, the image area IA is printed on surface S1 of media sheet N+6.

Figure 6A:
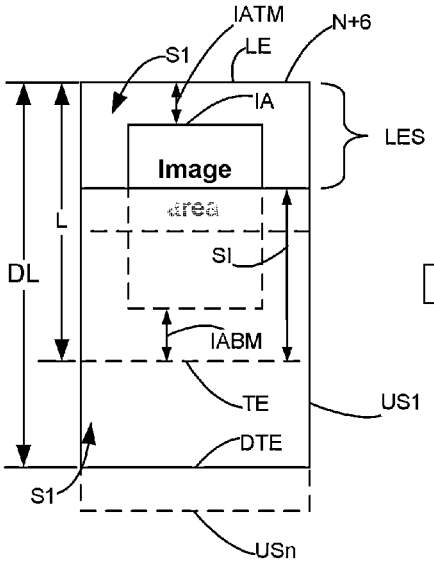
FIG. 6A illustrates shingle intrusion of an unexpected sheet occurring in an image area of a fed media sheet and FIG. 6B illustrates the image area being shifted and printed on the unexpected media sheet.
Figure 6B:
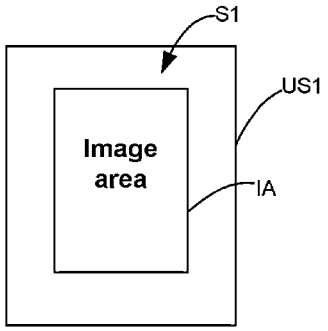

In FIG. 6A, unexpected sheet US1 has created a degree of shingle intrusion SI that does intrude upon image area IA of media sheet N+6 as the value of SI is greater than the IABM value. With this amount of shingle intrusion, controller 130 would recognize that image area IA cannot be printed on media sheet N+6 but can still be successfully printed if shifted onto unexpected sheet US1. Controller 130 knows the set length L is for media sheet N+6 either from sheet length sensor SL or from user input. Controller 130 also can determine the detected length DL for the combination of media sheet N+6 and unexpected sheet US1. A leading edge shift amount LES can be determined by controller 130 based on the difference between length L and the value of SI. Once controller 130 has determined the leading edge shift LES amount, then adding the leading edge shift LES to the value of the image area top margin IATM will place the image area IA at the appropriate location on the surface S1 of the unexpected sheet US1. In other words, the leading edge that is used for determining the location of the image area IA on the unexpected sheet corresponds to the location of the undetected but inferred leading edge of the unexpected sheet. The leading edge shift LES is accomplished by waiting a predetermined delay time based on process speed sufficient to move the combination of sheet N+6 and the unexpected sheet US1 in transfer nip 99 to the calculated position of the leading edge for the unexpected sheet US1. The delay time in printing allows the combination of sheets N+6 and US1 to move along media path 100 and into transfer nip 99 to a point on unexpected sheet US1 that corresponds to the point on sheet N+6 where image area IA would have started to have been printed had the shingling not have occurred. In other words, the delay in printing image area IA allows image area IA to be shifted to the appropriate location on the upstream unexpected sheet US1.

In our experience, shingling usually involves the feeding of the desired media sheet with only one unexpected sheet. Shingling of three or more sheets, i.e., the picked sheet plus two or more unexpected sheets, rarely occurs. However, the methods described herein may be used when multiple shingled sheets occur. For example if an unexpected sheet USn, where USn represents one or more additional unexpected sheets, is shingled onto unexpected sheet US1, the same considerations apply for both scenarios just described. The detected length DL may be greater if an unexpected sheet USn is not coincident with unexpected sheet US1 (see FIG. 6A). Of course, for where the amount of shingle intrusion exceeds the IABM value, image area IA would be transferred onto the surface of the last or uppermost unexpected sheet USn and not that of unexpected sheet US1.

With both scenarios, the combination media sheet N+6 and unexpected sheet US1 are still travelling along media path 100 as a unit and would pass through fuser assembly 110 and out to output area 30 and onto output media stack OMS. Because controller 130 knows the overall length of the combination of sheets N+6 and US1, the timing for rotation of the fuser assembly 110, and the downstream feed rolls and exit rolls 120 can be adjusted to ensure that the entire combination of these two sheets is ejected from media path 100.

Figure 7:
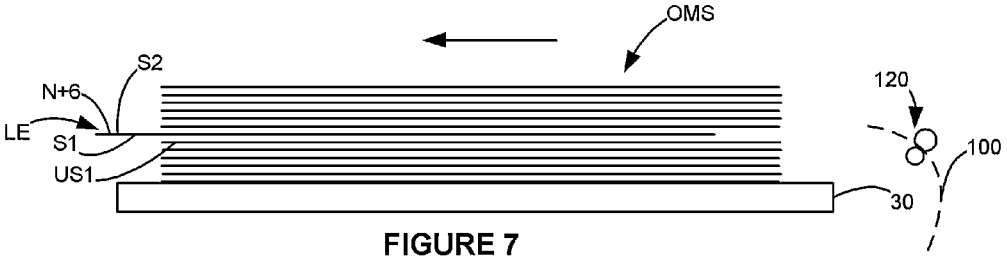
FIG. 7 illustrates an output media stack having an unexpected sheet therein.

FIG. 7 illustrates output media stack OMS with media sheet N+6 and unexpected sheet US1 having been ejected from media path 100. The leading edge LE of media sheet N+6 overhangs the vertical boundary of output media stack OMS allowing it to be easily spotted by the user. The amount of overhang corresponds approximately to the amount of shingle intrusion SI that occurred between media sheet N+6 and unexpected sheet US1.

With either scenario, controller 130 may also determine that printing could not successfully occur on sheet N+6 or on unexpected sheet US1 as the shift amount SA may exceed a preset limit. With such a determination, controller 130 may declare a misfed condition and alert the user to the problem or suspend printing operations until the misfed sheets are removed from media path 100.

Figure 8:
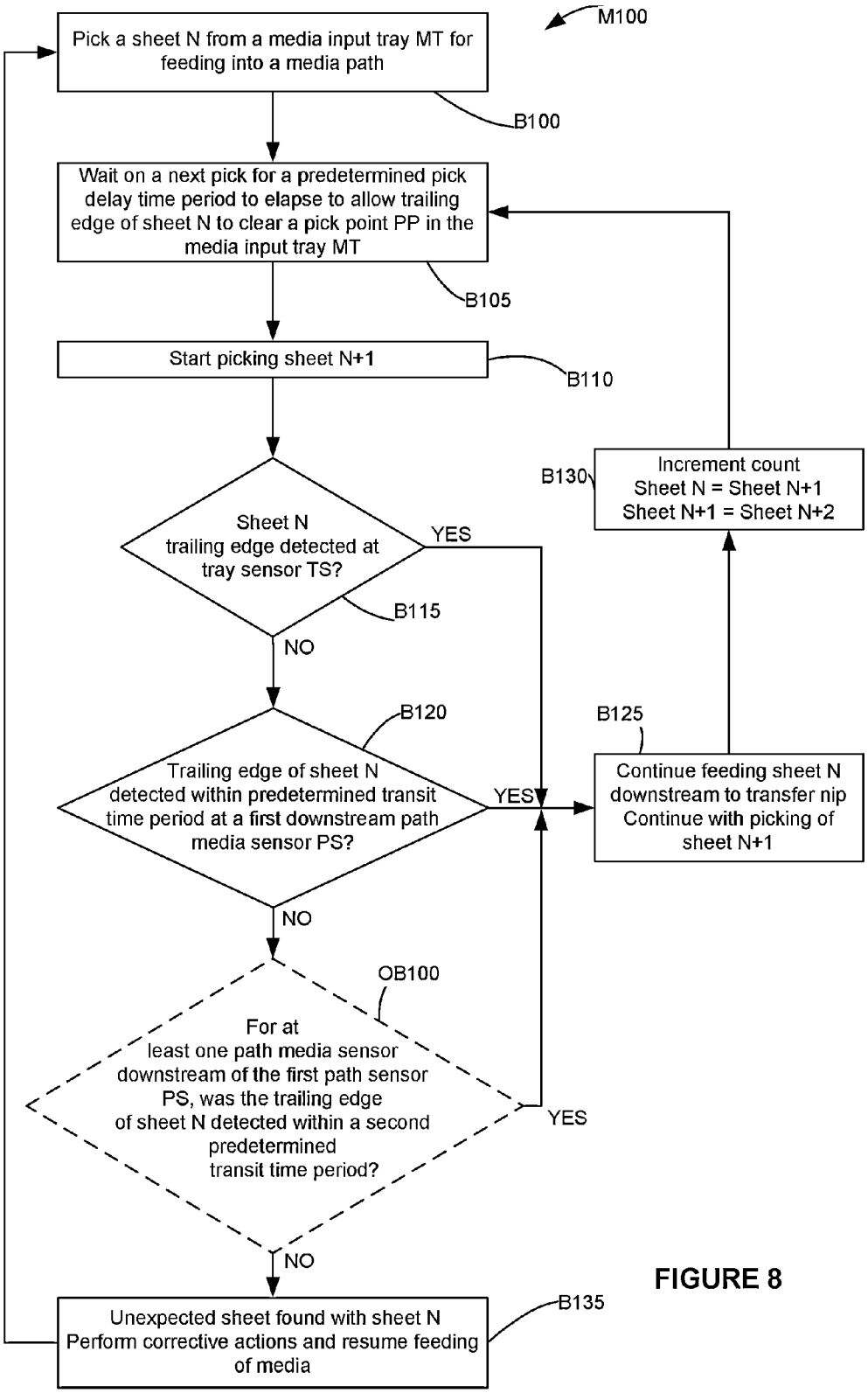
FIG. 8 is a flow chart illustrating in an imaging apparatus, a method of feeding sheets from a media sheet input area having an increased throughput.
Figure 9A:
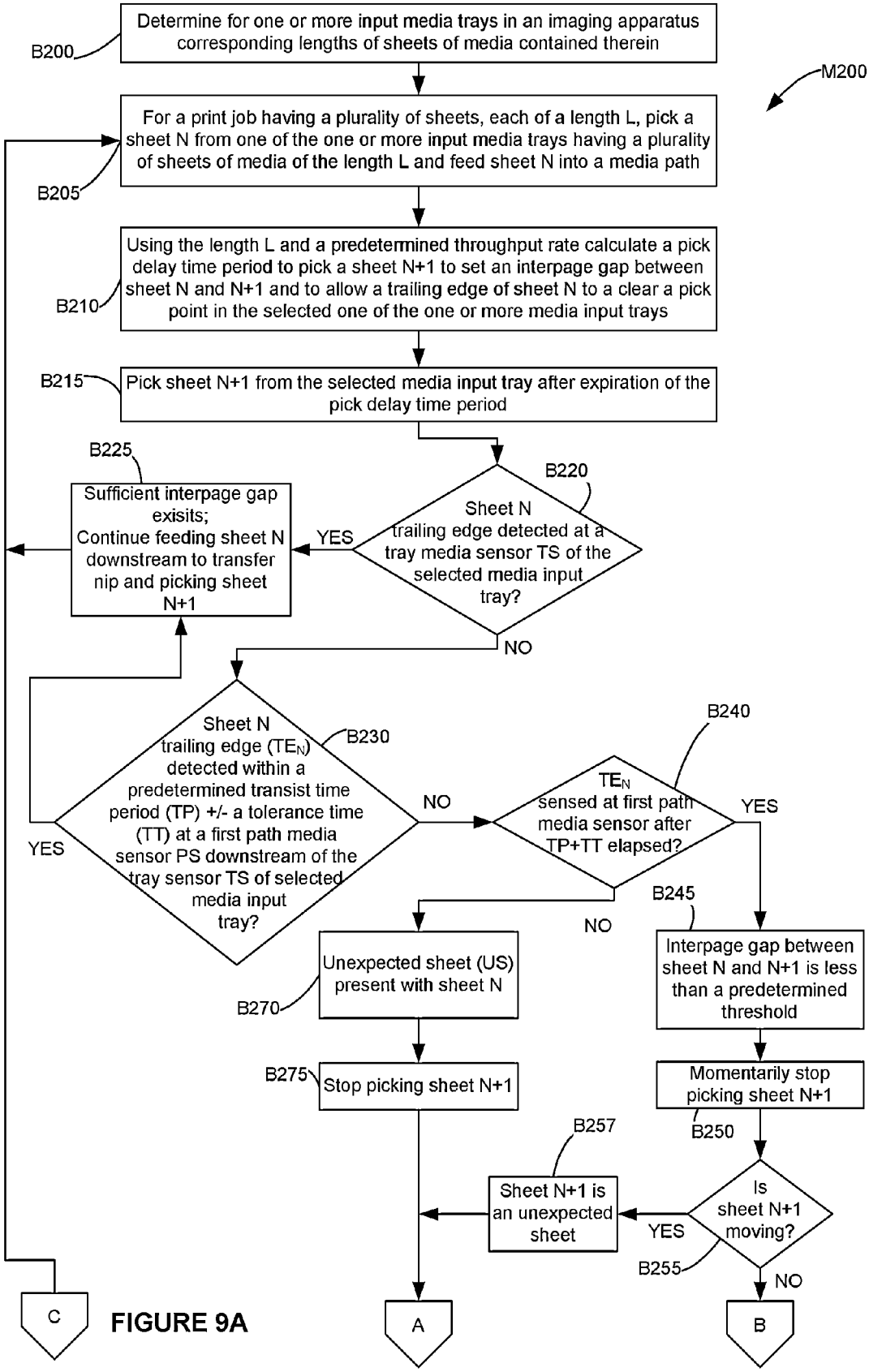
FIGS. 9A-9B is a flowchart illustrating in an imaging apparatus a further method of feeding sheets having an increased output and providing for misfeed sheets.
Figure 9B:
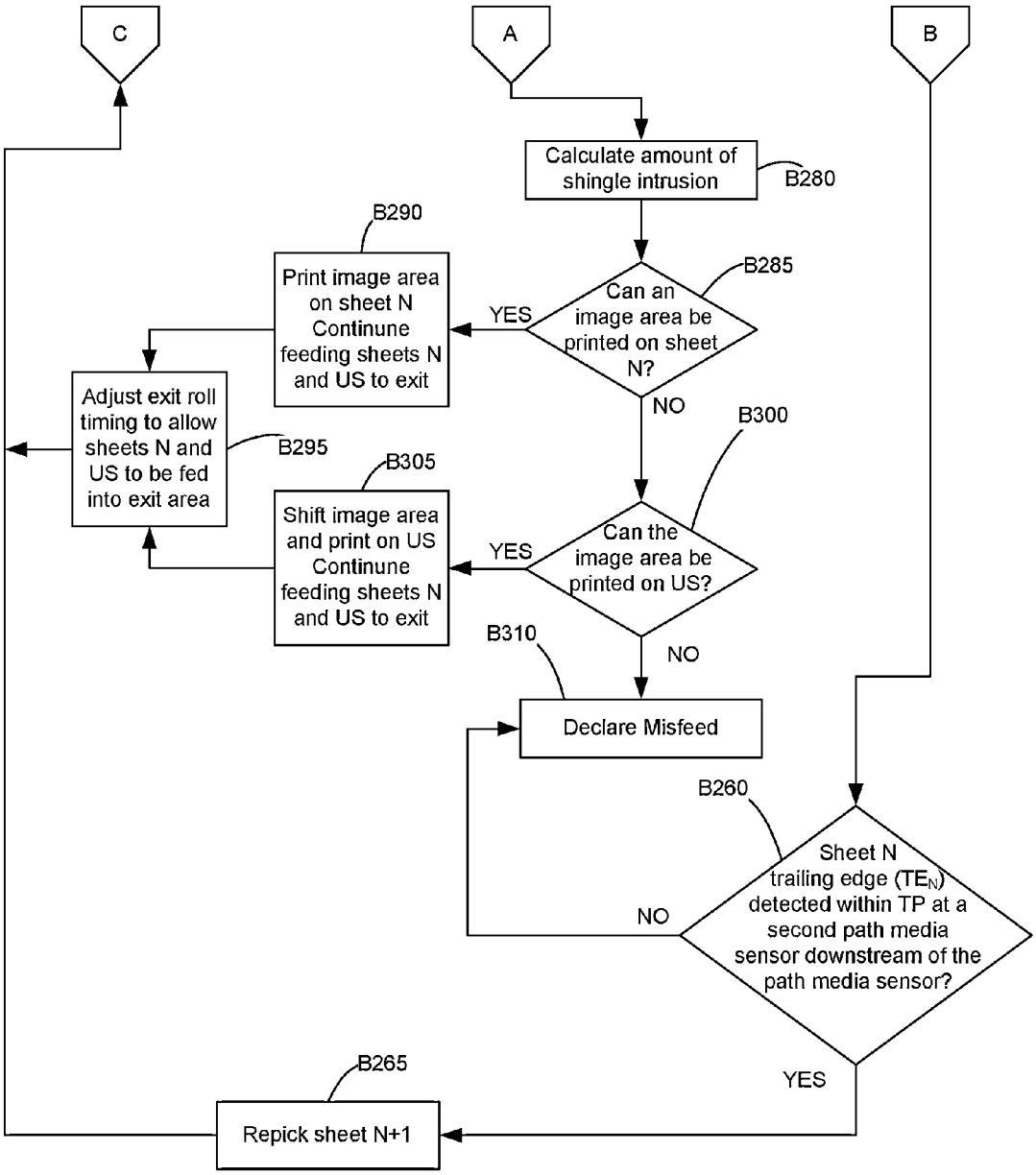

FIGS. 8-9B outline methods allowing for the increased throughput of media sheets by allowing a subsequent media sheet to be picked prior to the prior picked media sheet clearing a tray media sensor located adjacent to and downstream of the pick mechanism while providing for the handling of shingled media sheets.

In FIG. 8, method M100 begins at block B100 with the picking of media sheet N from a media tray, such as media tray MT, and feeding it into a media path, such as media path 100. At block B105, method M100 waits on picking a next media sheet N+1 for a predetermined pick delay time period to allow the trailing edge of picked media sheet N to clear a pick point, such as pick point PP in media tray MT, but has not yet reached the downstream tray media sensor TS. The pick delay time is also used to ensure an interpage gap occurring between media sheets N and N+1 will be sufficient to meet a predetermined process speed in pages per minute of sheet feeding through imaging apparatus 10 also termed the throughput rate. Picking of media sheet N+1 can occur prior to the trailing edge of media sheet N passing tray media sensor TS because media sheet N+1 needs to be accelerated from a stopped position on the media stack, and, in the time it takes media sheet N+1 to begin moving, the trailing edge of media sheet N will have cleared or moved downstream of tray media sensor TS due to the downstream feed rolls found on the media path. As the throughput rate increases, the interpage gap decreases, or the rotational speed of the feed rollers increases or both the interpage gap decreases and the speed of the feed rollers is increased.

At block B110, after the pick delay time period has elapsed, the picking of media sheet N+1 is started. Thereafter at block B115, a determination is made of whether or not the trailing edge of media sheet N is detected at tray media sensor TS. If a determination is made that the trailing edge of media sheet N has been detected by tray media sensor TS, method M100 proceeds to block B125 where media sheet N continues being fed down the media path to a transfer nip to receive the toned image and the picking of next media sheet N+1 continues in the same manner as media sheet N. Thereafter at block B130, a sheet count is incremented by 1 and method M100 returns to block B105 for checking the progress of next media sheet N+1 and to begin picking a new next media sheet N+2.

When the trailing edge of media sheet N is not detected by tray media sensor TS, this may not be a misfeed. Occasionally, the subsequent media sheet to be picked, here for example, media sheet N+1, is moved downstream in the removable media tray MT to a point that it prevents tray media sensor TS from detecting the trailing edge of the prior picked media sheet e.g., media sheet N. Some term this condition as "staging". So to check for staging, when, at block B115, a determination is made that the trailing edge of media sheet N has not been detected by tray media sensor TS, method M100 proceeds to block B120 where a determination is made to see whether or not the trailing edge of media sheet N has been detected within a predetermined transit time period. The transit time is the time between a media edge sensor detecting the leading edge of the media sheet being fed and detecting its trailing edge. The trailing edge check done at block B115 may be optional and the check of the trailing edge detection may occur only at a path media sensor PS downstream of tray media sensor TS.

Because controller 130 knows the length L associated with media sheet N as provided by length sensor SL or by user input, and the process speed, the transit time period across each tray media sensor TS and each path media sensor PS downstream of media tray MT can be calculated as each media sheet is being fed or may be precalculated and stored in memory 134 for use in making the determination in block B120. It should also be noted that because controller 130 knows, in addition to the previously mentioned factors, when media sheet N was picked, the travel time of the trailing edge of each media sheet being fed to each path media sensor PS downstream of media tray MT can be calculated as each media sheet is being fed or may be precalculated and stored in memory 134. Either transit times or travel times or both may be used when practicing method M100 or method M200.

At block B120, if YES, the trailing edge of media sheet N was detected at the downstream path media sensor within a predetermined transit time period, method M100 proceeds to block B125 where media sheet N continues being fed down the media path to a transfer nip to receive the toned image and ultimately out to exit area 30. Thereafter method M100 proceeds to block B130, previously described.

At block B120, if NO, a determination was made that the trailing edge of media sheet N has not been detected within a predetermined transit time period, method M100 proceeds to block B135 where an unexpected sheet, such as sheet US1, has been detected and corrective actions are performed. The corrective actions include stopping the picking of media sheet N+1, alerting a user to a misfeed, suspending imaging or printing, or determining that printing can successfully occur on either media sheet N or the unexpected sheet US1 as previously described.

As an alternative, should at least one additional path media sensor be present downstream of the path media sensor utilized in making the determination of block B120 and also be upstream of the transfer nip 99, then at optional block OB100 a determination may be made at the least one additional path media sensor downstream of the path media sensor PS used in block B120 whether or not the trailing edge of media sheet N is detected within the transit time period to the at least one additional path media sensor. If it is determined at optional block OB100 that the trailing edge of media sheet N was detected, method M100 proceeds to block B125 as previously described. If it is determined at optional block OB100 that the trailing edge of media sheet N was not detected at the at least one additional path media sensor, then method M100 proceeds to block B135, previously described.

FIGS. 9A-9B illustrate a further embodiment of a method of dynamically picking media sheets. Method M200 begins at block B200 where processor 130 determines for one or more media input trays, such as removable media input trays 16-26N, in an imaging apparatus, such as imaging apparatus 10, corresponding lengths of the media sheets contained therein. Next at block B205, for a print job having a plurality of sheets, each of a length L, a media sheet N is picked from an input media tray having a plurality of media sheets of the length L selected from one of the one or more media input trays and is fed into a media path, such as media path 100. At block B210, using the length L and a predetermined throughput rate, a pick delay time period is calculated for picking a media sheet N+1 to set an interpage gap between media sheet N and N+1 and to also allow a trailing edge of media sheet N to clear a pick point in the selected one of the one or more media input trays but not yet clear a tray media sensor, such as tray media sensors 260A-260N downstream of the pick point in respective media input trays 16-26N. The pick delay time period may be calculated as media sheet N is being feed or may be precalculated and recalled from memory 134.

At block B215, media sheet N+1 is picked after expiration of the pick delay time period. Next at block B220, a determination is made to see whether or not the trailing edge of media sheet N is detected at the tray media sensor TS of the selected media input tray. If NO, the trailing edge of media sheet N is not detected at the tray media sensor of the selected media input tray, method M200 proceeds to block B230. If YES, the trailing edge of media sheet N is detected at the tray media sensor of the selected media input tray, method M200 proceeds to block B225. At block B225, media sheet N continues to be fed downstream to the transfer nip 99 of imaging apparatus 10 and the picking of media sheet N+1 continues. Thereafter, method M200 continues to block B205 to repeat the process for the picking of media sheet N+2 and the continued feeding of media sheet N+1.

At block B230 a determination is made to see whether or not the trailing edge of media sheet N ($TE_N$) is detected within an allotted time comprised of a predetermined transit time period (TP)+/−a tolerance time (TT), at a first path media sensor PS downstream of the tray media sensor TS in selected media input tray. The first path media sensor PS is typically the first path media sensor in the media path 100 that is downstream of the pick point PP of media tray MT. If YES, a determination was made that $TE_N$ was detected within the allotted time, method M200 proceeds to block B225 where sufficient interpage gap between media sheet N and N+1 is present and the picking of media sheet N+1 continues. If NO, determination was made that $TE_N$ was not detected within the allotted time, method M200 proceeds to block B240.

The tolerance time TT is dependent upon a predetermined process speed and the length L of the media sheet being fed. For example if the media sheet feed rate is 55 pages per minute which translates to a process speed of 305 mm/sec for Letter media, the transit time period TP between the detection of a leading edge and a trailing edge at the path media sensor for Letter sized sheet having a length of 279 mm would take about 915 msec (media length÷process speed or 279 mm÷305 mm/sec). The trailing edge of media sheet N is expected to be detected within about 25 mm of movement of media sheet N. So for the process speed of 305 mm/sec, the tolerance time may be about 82 msec about the end of the expected transit time period TP of 915 msec. A table containing media length, process speeds and corresponding transit time periods, and tolerance times may be stored in memory 134 for use in the method 200. It should be noted for the various path and tray media sensors, the transit time period TP at each is proportional to media length and process speed and will be approximately the same during normal media feeding. However, because the process speed of the media sheet can change under the direction of controller 130 by adjusting the rotational speed of the feed rolls along the media path, the transit time period at a given media sensor may also be dynamically determined using the process speed of the media at the media sensor being used.

At block B240 a determination is made to see whether $TE_N$ of media sheet N was sensed at the first path media sensor PS after the time period of TP+TT had elapsed. If YES, a determination was that the trailing edge $TE_N$ was sensed at the path media sensor PS after the time period of TP+TT had elapsed, method M200 proceeds to block B245. If NO, a determination was that the trailing edge $TE_N$ was not sensed at the path media sensor PS after the time period of TP+TT had elapsed, method M200 proceeds to block B270.

At block B245, because the trailing edge $TE_N$ was detected later than expected, the interpage gap between media sheet N and N+1 is less than a predetermined threshold, and, accordingly, at block B250 the picking of media sheet N+1 is momentarily stopped to increase the interpage gap. There may be some instances that an interpage gap may not exist or the interpage gap may not be large enough as desired due to media slippage or other lost motion factors with respect to moving media sheet N, which can potentially cause paper jams as the media sheets are moved further downstream along media path 100. Such may be assumed when the trailing edge $TE_N$ of media sheet N is not detected within the predetermined transit time period TP at block B230. More particularly, when the trailing edge $TE_N$ of media sheet N is sensed shortly after the transit time period TP plus the time tolerance TT at block B240, the interpage gap does exist but it is less than a predetermined threshold value as indicated at block 245. On the other hand, when trailing edge $TE_N$ of media sheet N is not detected shortly after the predetermined transit time period TP plus the time tolerance TT, it can be interpreted that the interpage gap does not exist and that an unexpected sheet (US) is present with media sheet N at block B270. In response controller 130 controls pick mechanism PM to stop the picking of media sheet N+1 at block B275 when there is an unexpected sheet.

At the time the pick operation with respect to media sheet N+1 is momentarily stopped at block B250, the immediately downstream feed rolls still continue to rotate as well as other downstream feed rolls to move media sheet N further downstream media path 100, leaving media sheet N+1 within the media tray MT. This will be the case if the picking of media sheet N+1 is stopped before its leading edge has reached the nip of the feed rolls immediately downstream of media tray MT. However, if the leading edge of media sheet N+1 has already been engaged by the immediately downstream pair of feed rolls at the time the pick operation of media sheet N+1 is stopped, media sheet N+1 will still continue to move, as does media sheet N, further downstream media path 100. If this occurs, controller 130 may be configured to treat both sheets in the same manner as when an unexpected sheet occurs. Accordingly, subsequent to block B250, at block B255, a determination is made to see whether or not media sheet N+1 is still moving. Path media sensors may be used to determine whether or not media sheet N+1 is still moving. If YES, it is determined that media sheet N+1 is moving, method M200 proceeds to block B257 where media sheet N+1 is declared to be an unexpected sheet US and then to block B280 in FIG. 9B described infra. If NO, it is determined that media sheet N+1 is not moving, method M200 proceeds to block B260 in FIG. 9B where a further determination is made as to the location of media sheet N that continues to be transported along media path 100.

At block B260 a determination is made to see whether or not the trailing edge $TE_N$ of media sheet N has been detected within a second predetermined transit time period at a second path media sensor PS downstream of the first path media sensor PS and located upstream of transfer nip 99. For example, trailing edge $TE_N$ of media sheet N is monitored using a second path media sensor, such as PS(262) and downstream of path media sensor PS(260), relative to the direction of travel of the picked media sheets. When media sheet N is picked from media tray 16, the second path media sensor may be one of sensors 160, 162. When media sheet N is picked from media tray 26, the second path media sensor may be one of sensors 262A, 160, and 162 and so on as additional option assemblies are added to imaging apparatus 10. If YES, the second path media sensor detects the trailing edge $TE_N$ of media sheet N, at block B265, controller 130 engages pick mechanism PM to resume picking of media sheet N+1 and then back to block B205 to repeat the process. By doing this, a sufficient interpage gap is ensured between media sheet N and media sheet N+1.

At block B260, if NO, the trailing edge $TE_N$ of media sheet N is not detected at a second path media sensor downstream of the first path media sensor within a second predetermined time period, then process M200 may proceed to block B310 and declare a misfeed.

Referring back to block B270, because the trailing edge $TE_N$ of media sheet N has not been detected at block B240, an unexpected sheet US is present. Next at block B275 the picking of media sheet N+1 is stopped. At block B280, processor 130 calculates an amount of shingle intrusion between media sheet N and the unexpected sheet as previously described. At block B285 in FIG. 9B, based on the amount of shingle intrusion, a determination is made whether or not the image area can be printed on media sheet N. If YES, it is determined that the magnitude of shingle intrusion would permit the image area to be printed on media sheet N, then at block B290, the image area is printed on media sheet N and media sheet N and the unexpected sheet US continue to be fed to transfer nip 99 and ultimately to the exit area 30 via block B295 where the timing of the exit rolls (i.e., all downstream rolls) is adjusted to accommodate the combined length of media sheet N and the unexpected sheet US. Thereafter, method M200 returns to block B205 to process the next media sheet.

At block B285, if NO, it is determined that the magnitude of shingle intrusion would not permit the image area to be printed on media sheet N then at block B300 in FIG. 9B, a determination is made if the image area can be printed on the unexpected sheet US. If YES, it is determined that the image area can be printed on the unexpected sheet US, then at block B305, the image area is shifted and printed on the unexpected sheet US and media sheet N and the unexpected sheet US continue to be fed to transfer nip 99 and out to exit area 30 via block B295 previously described. Thereafter, method M200 returns to block B205 to process the next media sheet If NO, it is determined that the image area cannot be printed on the unexpected sheet US, method M200 returns to block B310 where a misfeed is declared.

The optional process blocks described for method M100 may also be used in method M200. Optional block OB100 would be inserted in the NO branch leading from block B240 to block B270. For a positive determination at optional block OB100 that the trailing edge $TE_N$ of media sheet N was detected at a subsequent downstream path media sensor, method 200 would proceed to block B235. For a negative determination at optional block OB100 that trailing edge $TE_N$ of media sheet N was not detected at a subsequent downstream path media sensor, method M200 would proceed to block B270.

The foregoing described processes M100, M200 of feeding media sheets is performed in an iterative fashion. With the above example embodiments, sheet feed systems 200A, 200B, etc. pick a next media sheet even if the media sheet ahead has not cleared the corresponding downstream tray sensor 260A, 260B, etc but aborts or pauses picking of the next media sheet if the media sheet ahead has not cleared the following path media sensor within a given time period. Picking of the next media sheet only resumes when the trailing edge of the media sheet ahead is detected by a next path media sensor. Higher throughput is thus achieved while providing robustness at the same time. Paper jams are also avoided as interpage gaps are maintained between fed media sheets.

The descriptions of the details of the example embodiments have been described using the feed systems associated with media trays 16-26N. However, it will be appreciated that the teachings and concepts provided herein are applicable to any paper input source such as multi-purpose feeders, ADFs, high capacity input trays, or other input options, or standard paper trays without departing from the scope of the present disclosure.

The foregoing description of several embodiments has been presented for purposes of illustration. It is not intended to be exhaustive or to limit the invention to the precise designs disclosed, and obviously many modifications and variations may be carried out in other specific ways than those herein set forth without departing from the scope and essential characteristics of the invention. It is intended that the scope of the invention be defined by the claims appended hereto.

What is claimed is:

1. In an imaging apparatus having a media input tray having a pick mechanism and a tray media sensor positioned downstream of a pick point in the media input tray, a media path for transporting a media sheet from the media input tray through an image transfer nip to receive a toned image from a print engine, and at least one pair of opposed feed rolls and a path media sensor positioned on the media path between the transfer nip and the media input tray, a method for feeding a plurality of media sheets comprising:

picking a media sheet N from the media input tray using the pick mechanism;

waiting for a predetermined pick delay time period to elapse in which a trailing edge of media sheet N clears the pick point but has not cleared the tray media sensor then picking a media sheet N+1; and determining whether the trailing edge of the media sheet N is detected by the tray media sensor, and, when the trailing edge of the media sheet N is detected, then continuing feeding the media sheet N to the transfer nip using the at least one pair of opposed feed rolls and waiting for the predetermined pick delay time for media sheet N+1 to elapse before beginning picking a media sheet N+2, and, when the trailing edge of the media sheet N is not detected by the tray media sensor, then:

determining whether or not the trailing edge of media sheet N is detected at the path media sensor within a predetermined transit time period, and, when it is determined that the trailing edge of media sheet N has been detected by the path media sensor within the predetermined transit time period, continuing feeding of media sheet N and media sheet N+1 to the transfer nip and the picking of media sheet N+2, and, when it is determined that the trailing edge of media sheet N has not been detected by the path media sensor within the predetermined transit time period, declaring a misfeed of media sheet N.

2. The method of claim 1 wherein the imaging apparatus has a second path media sensor along the media path between the transfer nip and prior to declaring a misfeed, determining whether or not the trailing edge of media sheet N is detected at the second path media sensor within a second predetermined transit time period, and, when it is determined that the trailing edge of media sheet N has been detected by the second path media sensor within the second predetermined transit time period, continuing feeding of media sheet N and media sheet N+1 to the transfer nip and the picking of media sheet N+2, and, when it is determined that the trailing edge of media sheet N has not been detected by the second path media sensor within the second predetermined transit time period, then declaring a misfeed of media sheet N.

3. In an imaging apparatus having one or more media input trays having a corresponding pick mechanism and a corresponding tray media sensor positioned downstream of a pick point in each of the one or more media input trays, a media path for transporting a media sheet from the one or more media input trays through an image transfer nip to receive a toned image from a print engine to an exit area, and at least one pair of opposed feed rolls and a path media sensor positioned on the media path between the transfer nip and the one or more media input trays, a method for feeding a plurality of media sheets comprising:

determining for each of the one or more input media trays corresponding lengths of sheets of media contained therein;

for a print job having a plurality of sheets, each of a length L, picking a media sheet N from a selected one of the one or more media input trays having a plurality of sheet of media of the length L and feeding the media sheet N into the media path;

using the length L and a predetermined throughput rate calculating a pick delay time period to pick a media sheet N+1 setting an interpage gap between the media sheet N and the media sheet N+1 and allowing a trailing edge of the media sheet N to a clear a pick point in the selected one of the one or more media input trays but remain upstream of the corresponding tray media sensor;

picking the media sheet N+1 from the selected one of the one or media input trays after expiration of the pick delay time period; and determining whether or not a trailing edge of the media sheet N is detected at the tray media sensor of the selected one of the one or more media input trays, and, when it is determined that the trailing edge of the media sheet N is detected at the tray media sensor of the selected one of the one or more media input trays, continuing the feeding of the media sheet N toward the transfer nip using the at least one pair of opposed feed rolls and continuing the picking of the media sheet N+1, and, when it is determined that the trailing edge of the media sheet N is not detected at the tray media sensor of the selected one of the one or more media input trays, then, determining whether or not the trailing edge of the media sheet N is detected within a predetermined transit time period plus and minus a tolerance time at a first path media sensor downstream of the tray media sensor of the selected one of the one or more media input trays, and, when it is determined that the trailing edge of the media sheet N is detected within the predetermined travel time period plus and minus a tolerance time at the first path media sensor, continuing the feeding of the media sheet N toward the transfer nip using the at least one pair of opposed feed rolls and continuing the picking of the media sheet N+1, and, when it is determined that the trailing edge of the media sheet N is not detected within the predetermined travel time period plus and minus a tolerance time at the first path media sensor, then, determining whether or not the trailing edge of the media sheet N is detected at the first path media sensor downstream of the tray media sensor of the selected one of the one or more media input trays after the predetermined transit time period plus the tolerance time has elapsed, and, when it is determined that the trailing edge of the media sheet N has been detected at the first path media sensor after the predetermined transit time period plus the tolerance time has elapsed, momentarily stopping the picking of media sheet N+1, and, when it is determined that the trailing edge of the media sheet N has not been detected at the first path media sensor after the predetermined transit time period plus the tolerance time has elapsed, declaring that an unexpected sheet has been fed and stopping the picking of the media sheet N+1.

4. The method of claim 3 further comprising:

when the unexpected sheet is declared:

calculating an amount of shingle intrusion between the media sheet N and the unexpected sheet; and determining, based on the calculated amount of shingle intrusion, whether or not an image area can be printed on the media sheet N, and, when it is determined that the image area is printable on the media sheet N, continuing to feed the media sheet N and the unexpected sheet to the transfer nip for printing, and, when it is determined that the image area is not printable on the media sheet N, then determining whether or not the image area can be printed on the unexpected sheet; and, when it is determined that the image area can be printed on the unexpected sheet, then, shifting the image area based on the calculated amount of shingle intrusion, continuing to feed the media sheet N and the unexpected sheet to the transfer nip, and printing the image area on the unexpected sheet, and when it is determined that the image area cannot be printed on the unexpected sheet, then declaring a misfeed.

5. The method of claim 4 wherein the imaging apparatus further comprises an opposed pair of exit rolls on the media path adjacent to the exit area, and, after the image area is printed on the media sheet N, adjusting an exit roll timing to allow for the media sheet N and the unexpected sheet to be fed into the exit area, and then feeding the media sheet N and the unexpected sheet into the exit area with the opposed pair of exit rolls.

6. The method of claim 4 wherein the imaging apparatus further comprises an opposed pair of exit rolls on the media path adjacent to the exit area, and, after the image area is printed on the unexpected sheet, adjusting an exit roll timing to allow for the media sheet N and the unexpected sheet to be fed into the exit area, and then feeding the media sheet N and the unexpected sheet into the exit area with the opposed pair of exit rolls.

7. The method of claim 4 further comprising:

after it has been determined that the trailing edge of the media sheet N was detected at the first path media sensor after the predetermined transit time period plus the tolerance time had elapsed and the picking of the media sheet N+1 had stopped, determining whether or not the media sheet N+1 is still moving along the media path, and, when it has been determined that the media sheet N+1 is not moving along the media path, then determining whether or not the trailing edge of the media sheet N has been detected within a second predetermined time period at a second path media sensor that is downstream of the first path media sensor, and, when it is determined that the trailing edge of the media sheet N has not been detected at the second path media sensor, declaring a misfeed of the media sheet N, and, when it is determined that the trailing edge of the media sheet N has been detected at the second path media sensor, re-picking the media sheet N+1.

8. The method of claim 7 when it has been determined that the media sheet N+1 is moving along the media path, then declaring the media sheet N+1 is the unexpected sheet and calculating an amount of shingle intrusion between media sheet N and the unexpected sheet.

9. The method of claim 4 wherein calculating the amount of shingle intrusion comprises:

at the path media sensor, detecting the leading edge of the media sheet N and the trailing edge of the unexpected sheet to determine a detected length DL; and subtracting detected length DL from twice the length L to determine the amount of shingle intrusion amount.

10. The method of claim 9 wherein determining based on the calculated amount of shingle intrusion whether or not the image area can be printed further comprises:

calculating an image area bottom margin; and comparing the image area bottom margin to the calculated amount of shingle intrusion;

and, when calculated amount of shingle intrusion is less than the image area bottom margin, proceeding to print the image area onto the media sheet N, and when calculated amount of shingle intrusion is equal to and greater than the image area bottom margin, then shifting a leading edge position of the image area upstream in the media path by an amount that is the difference between the length L and the calculated amount of the shingle intrusion and then proceeding to print the image area onto the unexpected sheet.

11. The method of claim 10 wherein the unexpected sheet comprises a plurality of unexpected sheets and, when a plurality of unexpected sheets occur, determining the detected length using a last unexpected sheet of the plurality of unexpected sheets and when it is determined that the image area is to be printed on the unexpected sheet; proceeding with printing of the image area on the last unexpected sheet of the plurality of unexpected sheets.

12. In an imaging apparatus having one or more media input trays having a corresponding pick mechanism and a corresponding tray media sensor positioned downstream of a pick point in each of the one or more media input trays, a media path for transporting a media sheet from the one or more media input trays through an image transfer nip to receive a toned image from a print engine to an exit area, a pair of opposed feed rolls and a path media sensor positioned on the media path between the transfer nip and the one or more media input trays, and, a pair of opposed exit rolls positioned on the media path between the transfer nip and the exit area, a method for feeding a plurality of media sheets comprising:

determining for each of the one or more input media trays corresponding lengths of sheets of media contained therein;

for a print job having a plurality of sheets, each of a length L, picking a media sheet N from a selected one of the one or more media input trays having a plurality of sheets of media of the length L and feeding the media sheet N into the media path;

calculating a pick delay time period to pick a media sheet N+1 using the length L and a predetermined throughput rate;

picking the media sheet N+1 from the selected one of the one or media input trays after expiration of the pick delay time period; and determining whether or not a trailing edge of the media sheet N is detected at the tray media sensor of the selected one of the one or more media input trays, and, when it is determined that the trailing edge of the media sheet N is detected at the tray media sensor of the selected one of the one or more media input trays, continuing the feeding of the media sheet N toward the transfer nip using the one or more opposed pairs of feed rolls and continuing the picking of the media sheet N+1, and, when it is determined that the trailing edge of the media sheet N is not detected at the tray media sensor of the selected one of the one or more media input trays, then, determining whether or not the trailing edge of the media sheet N is detected within a predetermined transit time period at a first path media sensor downstream of the tray media sensor of the selected one of the one or more media input trays, and, when it is determined that the trailing edge of the media sheet N is detected within the predetermined travel time period at the first path media sensor, continuing the feeding of the media sheet N toward the transfer nip using the one or more opposed pairs of feed rolls and continuing the picking of the media sheet N+1, and, when it is determined that the trailing edge of the media sheet N is not detected within the predetermined travel time period at the first path media sensor, then:

determining whether or not the trailing edge of the media sheet N is detected at the first path media sensor downstream of the tray media sensor of the selected one of the one or more media input trays after the predetermined transit time period plus a tolerance time has elapsed, and, when it is determined that the trailing edge of the media sheet N has been detected at the first path media sensor after the predetermined transit time period plus the tolerance time has elapsed, momentarily stopping the picking of media sheet N+1, and, when it is determined that the trailing edge of the media sheet N has not been detected at the first path media sensor after the predetermined transit time period plus the tolerance time has elapsed, declaring that an unexpected sheet has been fed and stopping the picking of the media sheet N+1; and when the unexpected sheet is declared:

calculating an amount of shingle intrusion between the media sheet N and the unexpected sheet; and determining, based on the calculated amount of shingle intrusion, whether or not an image area can be printed on the media sheet N, and, when it is determined that the image area is printable on the media sheet N, continuing to feed the media sheet N and the unexpected sheet to the transfer nip for printing, and, when it is determined that the image area is not printable on the media sheet N, then:

determining whether or not the image area can be printed on the unexpected sheet, and, when it is determined that the image area can be printed on the unexpected sheet, then, shifting the image area based on the calculated amount of shingle intrusion, continuing to feed the media sheet N and the unexpected sheet to the transfer nip, and printing the image area on the unexpected sheet, and when it is determined that the image area cannot be printed on the unexpected sheet, then declaring a misfeed.

13. The method of claim 12 wherein, after the image area is printed on the media sheet N, adjusting an exit roll timing to allow for the media sheet N and the unexpected sheet to be fed into the exit area, and then feeding the media sheet N and the unexpected sheet into the exit area with the pair of exit rolls.

14. The method of claim 12 wherein, after the image area is printed on the unexpected sheet, adjusting an exit roll timing to allow for the media sheet N and the unexpected sheet to be fed into the exit area, and then feeding the media sheet N and the unexpected sheet into the exit area with the pair of exit rolls.

15. The method of claim 12 further comprising:

after it has been determined that the trailing edge of the media sheet N was detected at the first path media sensor after the predetermined transit time period plus the tolerance time had elapsed and the picking of the media sheet N+1 had stopped, determining whether or not the media sheet N+1 is still moving along the media path, and, when it has been determined that the media sheet N+1 is not moving along the media path, then determining whether or not the trailing edge of the media sheet N has been detected within a second predetermined time period at a second path media sensor that is downstream of the first path media sensor, and, when it is determined that the trailing edge of the media sheet N has not been detected at the second path media sensor, declaring a misfeed of the media sheet N, and, when it is determined that the trailing edge of the media sheet N has been detected at the second path media sensor, re-picking the media sheet N+1.

16. The method of claim 15 when it has been determined that the media sheet N+1 is moving along the media path, then declaring the media sheet N+1 is the unexpected sheet and calculating an amount of shingle intrusion between media sheet N and the unexpected sheet.

17. The method of claim 12 wherein calculating the amount of shingle intrusion comprises:

at the path media sensor, detecting the leading edge of the media sheet N and the trailing edge of the unexpected sheet to determine a detected length DL; and subtracting detected length DL from twice the length L to determine the amount of shingle intrusion amount.

18. The method of claim 17 wherein determining based on the calculated amount of shingle intrusion whether or not the image area can be printed further comprises:

calculating an image area bottom margin; and comparing the image area bottom margin to the calculated amount of shingle intrusion, and, when calculated amount of shingle intrusion is less than the image area bottom margin, proceeding to print the image area onto the media sheet N, and when calculated amount of shingle intrusion is equal to and greater than the image area bottom margin, then shifting a leading edge position of the image area upstream in the media path by an amount that is the difference between the length L and the calculated amount of the shingle intrusion and then proceeding to print the image area onto the unexpected sheet.

19. The method of claim 18 wherein the unexpected sheet comprises a plurality of unexpected sheets and, when a plurality of unexpected sheets occur, determining the detected length using a last unexpected sheet of the plurality of unexpected sheets and when it is determined that the image area is to be printed on the unexpected sheet; proceeding with printing of the image area on the last unexpected sheet of the plurality of unexpected sheets.

* * * * *